US005253149A

United States Patent [19]

Ostema et al.

[11] Patent Number: 5,253,149

[45] Date of Patent: Oct. 12, 1993

[54] ILLUMINATED JEWELRY

[76] Inventors: Loren D. Ostema, 2349 Wells Ave., Sarasota, Fla. 34232-3961; Jonathan L. Kaye, 2815 Marshall Dr., Sarasota, Fla. 34239

[21] Appl. No.: 7,110

[22] Filed: Jan. 21, 1993

[51] Int. Cl.[5] ..... F21L 15/08

[52] U.S. Cl. ..... 362/104; 362/800

[58] Field of Search ..... 362/103, 104, 800, 226; 24/705; 63/1.1, 12

[56] References Cited

U.S. PATENT DOCUMENTS

| | | | |
|---|---|---|---|
| 4,237,525 | 12/1980 | Deter . | |
| 4,271,457 | 6/1981 | Martin | 362/104 |
| 4,337,504 | 6/1982 | Simpson | 362/104 |
| 4,408,261 | 10/1983 | Polakoff . | |
| 4,459,645 | 7/1984 | Glatter . | |
| 4,719,544 | 1/1988 | Smith . | |
| 5,018,053 | 5/1991 | Balknap . | |
| 5,140,840 | 8/1992 | Miceli . | |

*Primary Examiner*—Richard R. Cole
*Attorney, Agent, or Firm*—Charles J. Prescott

[57] ABSTRACT

Illuminated jewelry connectable to a wearer as an earring, a clothes pendant or the like includes a light-emitting diode (LED) connected onto an enlarged flat base member at one end of an elongated stem. A miniature battery housing also includes a stem cavity positioned immediately adjacent and generally coextensive with the battery compartment to supportively receive and releasably retain the distal portion of the stem therewithin. The stem and housing are structured so that an electrical circuit is completed between the battery and the LED through the stem when the stem is fully inserted to the bottom of the stem cavity. In this configuration, a gap between the enlarged base member and the housing generally equal to the thickness of the wearer's earlobe or article of clothing is defined. A transparent lens over the LED may be provided to enhance decorative illumination. The stem preferably has two detented positions within the stem cavity, the first a partially inserted position wherein the device may be held for wearing and storage without LED illumination and a second fully inserted position when the LED is illuminated.

12 Claims, 1 Drawing Sheet

ILLUMINATED JEWELRY

BACKGROUND OF THE INVENTION

1. Scope of Invention

This invention relates generally to illuminated jewelry, and more particularly to light emitting diode-type miniature jewelry having a uniquely configured compact battery housing and stem for supporting the LED and energy conserving features.

2. Prior Art

It is well-known to utilize illuminated jewelry for earrings, body lights and for illuminated articles of clothing. However, in addition to being relatively cumbersome, such prior art devices are also relatively unreliable, short-lived and fail to achieve a desirable level of ornamentality and illumination.

One good attempt to meet these needs is disclosed in U.S. Pat. No. 4,237,525 invented by Deter which teaches illuminated jewelry using a miniature battery as an LED base for an earring for a pierced earlobe. Although this devices appears relatively compact and functional, the level of ornamentality appears to be diminished by the utilitarian structural mounting of the LED and illumination time would be limited.

A very recent patent issued to Miceli in U.S. Pat. No. 4,140,840 teaches an electrical earring for a pierced earlobe containing an LED light-enhancing display light element such as a translucent stone. However, this device is relatively complex in nature, depending on a light transmitting post for transferring light emitting from a small LED mounted against the back or base of the earring formed of a small battery.

Several other attempts toward the development of economically manufacturable, reliable and marketable LED jewelry are disclosed in U.S. Pat. No. 5,018,053, 4,719,544, 4,408,261 and 4,459,645. The complexity of these devices, in combination with their failure to have ever been marketed successfully, speak to their ineffectiveness.

The present invention represents a step beyond the above-described prior art toward a compact and acceptably decorative longer-life piece of LED-illuminated jewelry.

BRIEF SUMMARY OF THE INVENTION

This invention is directed to illuminated jewelry connectable to a wearer as an earring, a clothes pendant or the like includes a light-emitting diode (LED) connected onto an enlarged flat base member at one end of an elongated stem. A miniature battery housing also includes a stem cavity positioned immediately adjacent and generally coextensive with the battery compartment to supportively receive and releasably retain the distal portion of the stem therewithin. The stem and housing are structured so that an electrical circuit is completed between the battery and the LED through the stem when the stem is fully inserted to the bottom of the stem cavity. In this configuration, a gap between the enlarged base member and the housing generally equal to the thickness of the wearer's earlobe or article of clothing is defined. A transparent lens over the LED may be provided to enhance decorative illumination. The stem preferably has two detented positions within the stem cavity, the first a partially inserted position wherein the device may be held for wearing and storage without LED illumination and a second fully inserted position when the LED is illuminated.

It is therefore an object of this invention to provide enhanced LED-illuminated jewelry for use as both an earring for pierced earlobes and for connection to articles of clothing.

It is yet another object of this invention to provide illuminated jewelry having a uniquely configured stem for both supporting an LED and its transparent enclosing lens, while also serving as a dual electrical conductor between the LED and miniature batteries within the compact battery housing.

It is yet another object of this invention to provide illuminated jewelry which may be worn securely with the LED either illuminated or otherwise for energy conserving.

It is yet another object of this invention to incorporate state of the art microchip electronics in combination with an LED for miniaturization and effective decorative appeal.

In accordance with these and other objects which will become apparent hereinafter, the instant invention will now be described with reference to the accompanying drawings.

DETAILED DESCRIPTION OF THE INVENTION

Figure 1:
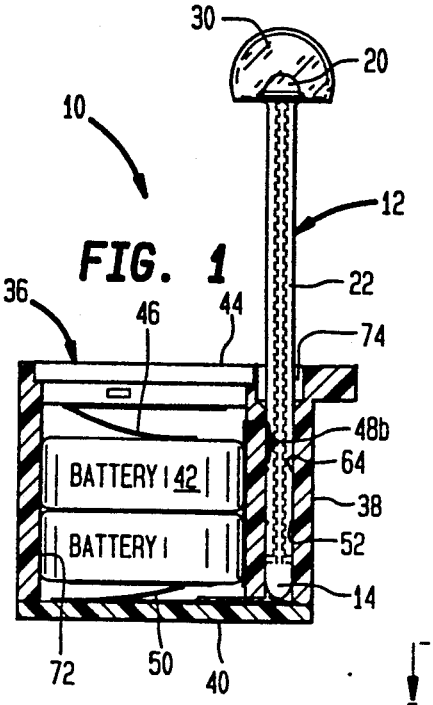
FIG. 1 is a side elevation partial section view of the invention.
Figure 2:
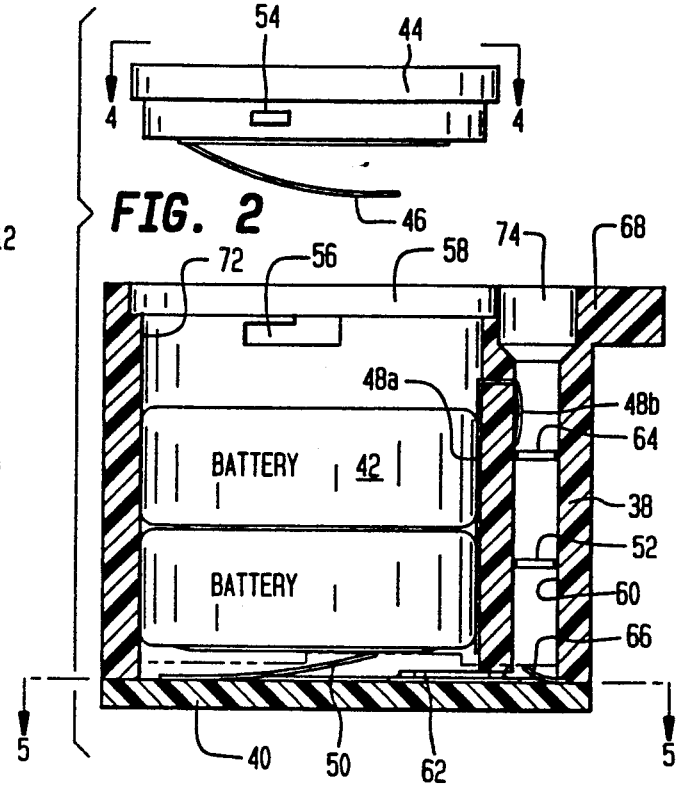
FIG. 2 is an enlarged exploded partial section view of the battery housing shown in FIG. 1.
Figure 4:
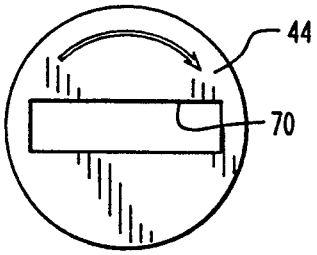
FIG. 4 is a view in the direction of arrows 4—4 in FIG. 2.
Figure 5:
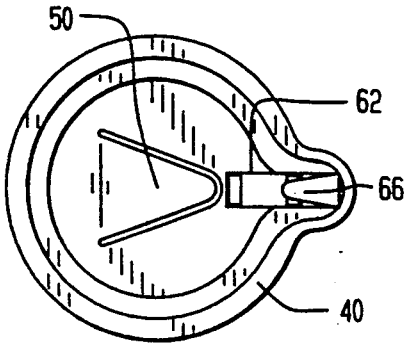
FIG. 5 is a view in the direction of arrows 5—5 in FIG. 2.

Referring now to the drawings, the invention is shown in FIG. 1 generally at numeral and includes a stem assembly 12 and a battery housing assembly 36. As best seen in FIGS. 2, 4 and 5, the battery housing 36 includes a plastic molded battery case 38, preferably molded of transparent plastic for decorative effect, the case 38 sized to receive a pair of miniature silver oxide batteries 42 closely fitted within a defined compartment 72 as shown. A cap 44 lockably engages into groove 58 by locking tab 54 into a matching notch 56 molded into the inner surface of the battery compartment of case 38 as seen in FIG. 2. This cap 44 includes biasing member 46 which presses against miniature batteries 42 for retention. A coin receiving slot 70 is also provided for removal and reinstallation and tightening of the cap 44 as shown in FIG. 4.

The battery housing 36 also includes an elongated stem cavity 60 integrally formed as part of case 38, the stem cavity 60 being positioned immediately adjacent, parallel to and coextensive with the battery compartment 72. The stem cavity 60 includes an enlarged opening 74 for initial alignment of the earring stem 22 which will be described herebelow. Also included along the length of the stem cavity 60 are a pair of inwardly extending beads 52 and 64 which interengage into an annular groove 34 formed into the stem 22 described herebelow.

Two electrical contacts **48*b* and 66 are also provided within battery housing 36. Electrical contact 48*b*** is positioned at a mid point along the length of stem cavity 60 and extends into the battery compartment 72 at 48*a* so as to make an electrical connection with the upper battery 42 as seen in FIG. 2. The other electrical contact 66, positioned at the bottom of stem cavity 60 as best seen in FIGS. 2 and 5, extends along the inner surface of bottom plate 40 through a current limiting microchip resistor 62 and to contact 50 which biasingly bears against the positive terminal of the lower battery 42 as best seen in FIGS. 1 and 2. The chip resistor 62 is provided so as to maximize battery life. The battery housing 36 also includes a tab or flange 68 to facilitate manipulation of the battery housing 36 during handling and installation and servicing of the batteries 42.

Figure 3:
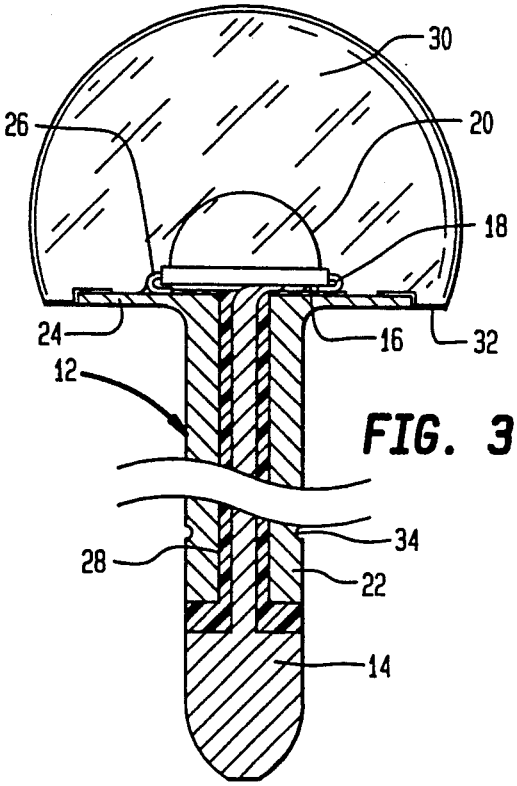
FIG. 3 is an enlarged partial section broken view of the stem assembly shown in FIG. 1.

The stem assembly 12 as best seen in FIG. 3, includes a slender elongated cylindrical inner shaft 14 and an outer shaft 22 surrounding the inner shaft 14. Both shafts 14 and 22 are fabricated of decorative metallic material such as gold. The inner shaft 14 forms a rounded distal end of the stem at one end to facilitate installation and includes an electrical contact 16 at its opposite end. The outer cylindrical shaft 22 is electrically insulated from the inner shaft 14 by a layer of insulation material 28. The outer shaft 22 is not fully coextensive with the inner shaft 14 at the distal end thereof, but is fully coextensive at the opposite end, terminating in a flat disc-shaped molded base 24.

A microchip light emitting diode (LED) 20 is mounted by its contact terminals 18 and 26 atop base 24 as shown in FIG. 3. By utilizing a microchip LED 20 in the preferred embodiment, the overall size of the LED is reduced, while still affording the illumination benefits of a conventional LED. Terminal 26 is in electrical communication only with base 24 of the outer shaft 22, while terminal 18 is in electrical communication only with the inner shaft 14 via contact portion 16.

To enhance the illumination and decorative effect of this invention 10, a transparent spherically shaped lens 30 is connected onto base 24 by flanges 32. This lens 30 enhances both the size and illumination effect of the device 10.

The annular groove 34 is formed transversely around the outer surface of the outer shaft 22 adjacent the distal end of the inner shaft 14. This groove 34 operably interacts with either bead 64 or bead 52 within stem cavity 60 as previously described. When annular groove 34 is interengaged with bead 64, the stem assembly 12 is fully supported with respect to the battery housing 36, but LED 20 is not illuminated because the electrical circuit is not completed. However, when the stem assembly 12 is fully inserted within stem cavity 60 so that the distal end of the inner shaft 14 bears against contact 66, groove 34 simultaneously engages with locking bead 52 an electrical contact 48*b* bears against the outer shaft 22. In this configuration of the stem assembly 12 within stem cavity 60, an electrical circuit is completed between batteries 42 and the LED 20 and there is light.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. Illuminated jewelry comprising:

a light emitting diode (LED) connected at an end of an elongated slender stem;

said stem defined by an electrically conductive central inner shaft and an electrically conductive outer shaft, said inner an outer shafts electrically isolated one from another;

said inner shaft coextensive with said stem and defining a distal end thereof, an opposite end of said inner shaft connected to a terminal of said LED;

said outer shaft extending along said stem from a second terminal of said LED toward but not to said inner shaft distal end;

a miniature battery housing defining a compartment for receiving and holding a miniature battery therein;

said battery housing including an elongated stem cavity positioned immediately adjacent, parallel to, and generally coextensive with said compartment, said stem cavity sized to supportively receive and closely mate around a distal portion of said stem therein, said stem being in electrical contact with a battery held within said compartment when fully inserted into said stem cavity;

said stem being longer than the length of said stem cavity whereby, when said stem is fully within said cavity, a gap is defined between said LED and said battery housing generally equal to the thickness of a wearer's earlobe or article of clothing.

2. Illuminated jewelry as set forth in claim 1, further comprising:

a transparent contoured lens connected to said stem and positioned and shaped to enclose said LED.

3. Illuminated jewelry as set forth in claim 2, further comprising:

a first detent means between said stem and said stem cavity for releasably maintaining said stem fully inserted into said cavity.

4. Illuminated jewelry as set forth in claim 3, further comprising:

a second detent means between said stem and said stem cavity for releasably maintaining a partially inserted relative position between said stem and said stem cavity whereby said stem is supported within said stem cavity during use or storage, yet electrically isolated from said battery.

5. Illuminated jewelry as set forth in claim 4, wherein:

said LED is a microchip LED;

an electrical circuit between a positive terminal of said battery includes a microchip resistor.

6. Illuminated jewelry comprising:

a light emitting diode (LED) connected at one end of an elongated slender shaft;

said stem including two electrically conductive portions electrically isolated one from another, each said electrically conductive portion in electrical communication with a terminal of said LED;

a molded miniature battery housing structured for holding at least one miniature disc-shaped battery therewithin and having a stem cavity positioned immediately adjacent and perpendicular to a plane defined by said battery;

said stem cavity supportively receiving said stem inserted therein, said housing including electrical conduit means between a terminal of said battery and one said conductive portion of said stem whereby said LED is energized when said stem is inserted fully into said stem cavity, and further comprising a first detent means between said stem and said stem cavity for releasably maintaining said stem fully inserted into said cavity and a second detent means between said stem and said stem cavity for releasably maintaining a partially inserted relative position between said stem and said stem cavity whereby said stem is supported within said stem cavity during use or storage, yet electrically isolated from said battery.

7. Illuminated jewelry as set forth in claim 6, further comprising:

a transparent contoured lens connected to said stem and positioned and shaped to enclose said LED.

8. Illuminated jewelry comprising:

a light emitting diode connected onto a flat base member formed at an enlarged disc-shaped end of an elongated, cylindrical slender stem;

said base member defined by a generally coplaner first and second base portion each electrically isolated one from another;

said stem defined by an electrically conductive central inner shaft and an electrically conductive outer shaft which surrounds said inner shaft along a portion thereof, said inner and outer shafts electrically isolated one from another;

said inner shaft coextensive with said stem and defining a generally pointed distal end thereof, an opposite end of said inner shaft extending to and integral with said first base portion;

said outer shaft extending along said stem from and integral with said second base portion toward but not to said inner shaft distal end;

a miniature battery housing defining a compartment for receiving and holding a miniature battery therein and also defining an elongated stem cavity generally coextensive with said housing having an open end and a bottom and positioned immediately adjacent and parallel to said compartment sized to receive and closely mate around a distal portion of said stem;

said stem being in electrical contact with said battery when said stem is fully inserted into said stem cavity and said distal end is against said bottom;

said stem being longer than the length of said stem cavity whereby, when said stem is fully within said stem cavity, a gap is formed between said base member and said battery housing along said stem generally equal to the thickness of a wearer's earlobe or article of clothing.

9. Illuminated jewelry as set forth in claim 8, further comprising:

a transparent contoured lens connected to said stem and positioned and shaped to enclose said LED.

10. Illuminated jewelry as set forth in claim 9, further comprising:

a first detent means between said stem and said stem cavity for releasably maintaining said stem fully inserted into said cavity.

11. Illuminated jewelry as set forth in claim 10, further comprising:

a second detent means between said stem and said stem cavity for releasably maintaining a partially inserted relative position between said stem and said stem cavity whereby said stem is supported within said stem cavity during use or storage, yet electrically isolated from said battery.

12. Illuminated jewelry as set forth in claim 11, wherein:

said LED is a microchip LED;

an electrical circuit between a positive terminal of said battery includes a microchip resistor.

* * * * *